US005939964A

United States Patent [19]

Domigan

[11] Patent Number: 5,939,964

[45] Date of Patent: Aug. 17, 1999

[54] COMPACT MAGNETIC MODULE FOR PERIODIC MAGNETIC DEVICES

[75] Inventor: Paul Domigan, Andover, Mass.

[73] Assignee: Intermagnetics General Corporation, Latham, N.Y.

[21] Appl. No.: 08/926,183

[22] Filed: Sep. 9, 1997

Related U.S. Application Data

[63] Continuation of application No. 08/277,407, Jul. 19, 1994, abandoned.

[51] Int. Cl.[6] ..... H01F 7/02; H01J 23/08

[52] U.S. Cl. ..... 335/306; 335/210; 335/298; 315/5.35

[58] Field of Search ..... 335/216, 296–306; 324/318, 319, 320; 315/5.35

[56] References Cited

U.S. PATENT DOCUMENTS

| | | | |
|---|---|---|---|
| 3,768,054 | 10/1973 | Neugebauer | 335/304 |
| 4,675,609 | 6/1987 | Danby et al. | 324/318 |
| 4,707,663 | 11/1987 | Minkoff et al. | 324/319 |
| 4,731,598 | 3/1988 | Clarke | 335/210 |
| 4,764,743 | 8/1988 | Leupold et al. | 335/306 |
| 4,953,555 | 9/1990 | Leupold et al. | 335/304 |
| 5,019,863 | 5/1991 | Quimby | 335/210 |

OTHER PUBLICATIONS

"Synchrotron Radiation", Herman Winick, pp. 72–81.

*Primary Examiner*—Michael L. Gellner
*Assistant Examiner*—Raymond Barrera
*Attorney, Agent, or Firm*—Helfgott & Karas, P.C.

[57] ABSTRACT

A magnetic array for periodic magnetic devices is formed as a series of pole modules each constructed from rectangular components. Field strengths in excess of 2.0 T are achieved by surrounding each pole module on all available sides with magnet blocks. Less magnet material is used than in prior modules that produced equal field strengths and magnet material is more efficiently used by reducing the material scrap associated with manufacture of prior art pole and magnet designs.

18 Claims, 4 Drawing Sheets

COMPACT MAGNETIC MODULE FOR PERIODIC MAGNETIC DEVICES

This is a continuation of application Ser. No. 08/277,407, filed Jul. 19, 1994 abondoned.

BACKGROUND OF THE INVENTION

1. Field of the Invention

The present invention relates in general to magnetic arrays for use with periodic magnetic devices such as synchrotrons, free electron lasers, wigglers, undulators, and magnetic separators, and particularly to such arrays constructed with magnets which surround poles on substantially all available pole surfaces.

2. Description of Prior Developments

Synchrotrons are used to produce certain types of radiation, such as ultraviolet light and x-rays, by forcing a stream of electrons to follow a curved path. In order to increase the brightness and intensity of this radiation, the electrons are directed through a series of magnetic fields that alternate in polarity and that are perpendicular to the electrons' direction of travel. These magnetic fields cause the electrons to follow a sinusoidal path and thereby increase the intensity and brightness of the radiation produced in accordance with known practice.

The magnets which are used to produce these alternating magnetic fields are known as wiggler magnets or undulator magnets. The difference between wiggler magnets and undulator magnets is in the degree of angular deflection produced by their magnetic poles. The deflection angle of a wiggler array is much greater than the natural emission angle of synchrotron radiation while the angular deflection produced by each set of poles in an undulator magnet array is less than or comparable to the natural emission angle.

Such magnets are presently required to produce extremely high field strengths, often in excess of two Tesla (2.0 T). Prior wiggler and undulator magnet designs have employed rare earth permanent magnets spaced between steel pole pieces. Practical field strengths of 1.8 T have been achieved with these designs. However, all known prior hybrid wiggler and undulator designs apply magnet material to only two sides or faces of each pole.

In order to introduce direct flux into the remaining three pole faces not facing the gap through which the electron beam passes, prior designs have oversized the magnets to extend beyond or overhang the pole faces in contact with the magnet material. This resulted in the use of significantly large amounts of costly magnet material and required a relatively large envelope within which to mount the magnet arrays.

One particular magnet array suitable for use with synchrotrons is disclosed in U.S. Pat. No. 5,019,863 which is incorporated herein by reference. The magnet array disclosed in this patent requires the use of tapered or wedge-shaped pole pieces and permanent magnets in order to allow a greater volume of magnet material to be placed between the poles. Although this arrangement functions adequately for its intended purpose, it's design is not the most economical.

That is, wedge-shaped magnets and poles are typically machined from rectangular blocks thereby necessitating removal of costly raw materials and requiring significant time for machining and grinding. Moreover, this particular design requires a relatively long or tall pole height in order to achieve high magnetic field strengths as is customary with designs which apply magnets to only two faces of each pole.

Accordingly, a need exists for a magnetic array suitable for use with synchrotron wiggler and undulator devices and which is able to produce high magnetic field strengths while being economical to manufacture.

A further need exists for such a magnetic array which is compact in size so as to reduce the amount of costly magnetic material required to produce a given magnetic field strength.

SUMMARY OF THE INVENTION

The present invention has been developed to meet the needs noted above, and therefore has as a primary object the provision of a magnetic assembly for wiggler and undulator devices which reduces the amount of magnet and pole material required for a given field strength and thereby reduces material cost.

Another object is to provide such a magnetic assembly which allows for a smaller pole height and a correspondingly more compact magnet array than previously achievable, and which facilitates fabrication and assembly and thereby further reduces cost.

Another object is to produce higher field strengths than previously attained using rare earth permanent magnet arrays constructed from easily produced rectangular blocks.

These objects are met by the present invention which uses rectangular magnets and poles which are simple to make and assemble and which require minimal machining. Instead of placing magnets along only two sides of each pole, as is the current practice, the present invention surrounds the poles with magnet material on five sides. This arrangement permits higher field strengths to be achieved than are now currently possible while making more efficient use of magnet and pole materials.

Moreover, the resulting design reduces the required pole height for a given field strength thereby lowering cost and resulting in a more compact design. Field strengths in excess of 2.0 T are achievable in accordance with the present invention.

A particularly significant feature of the invention is the application of neodymium blocks to all available faces of the poles. Although the present invention also takes advantage of magnetic material overhang, a dramatic increase in direct flux introduction into the poles is achieved by applying rectangular blocks of magnetic material directly to the top and sides of the rectangular poles. The top and side magnet blocks allow for the use of a far smaller or shorter pole and for less permanent magnet material than is required with prior designs such as in the wedge-shaped pole design noted previously.

Both the poles, which may be fabricated from steel or preferably vanadium permendur and the magnets which may be fabricated from rare earth materials such as NdFeB (neodymium-iron-boron), are initially made in rectangular parallel-piped shapes.

Typical wiggler and undulator magnet arrays have poles with widths that are approximately 5 times larger than the pole thickness. With these typical dimensions, the surface area of the top and sides of the pole piece is small compared with the total surface area of the pole. Hence, the sides and top of the pole have a small effect on the magnetic field strength. However, with the present invention, the pole width is approximately 1.4 times larger than the pole thickness. This means that the top and sides of the pole constitute a significant fraction of the total pole surface area and can contribute strongly to the achievable field strength. By covering the tops and sides of the pole with magnet material, more direct flux is added to the pole and less indirect leakage flux leaves the pole due to its decreased size.

The advantage of enclosing, at least partially, the top and sides of the pole with permanent magnets is not limited to rectangular poles and magnets.

The aforementioned objects, features and advantages of the invention will, in part, be pointed out with particularity, and will, in part, become obvious from the following more detailed description of the invention, taken in conjunction with the accompanying drawings, which form an integral part thereof.

BRIEF DESCRIPTION OF THE DRAWINGS

In the drawings.

In the various figures of the drawing, like reference characters designate like parts.

DETAILED DESCRIPTION OF THE PREFERRED EMBODIMENTS

Figure 1:
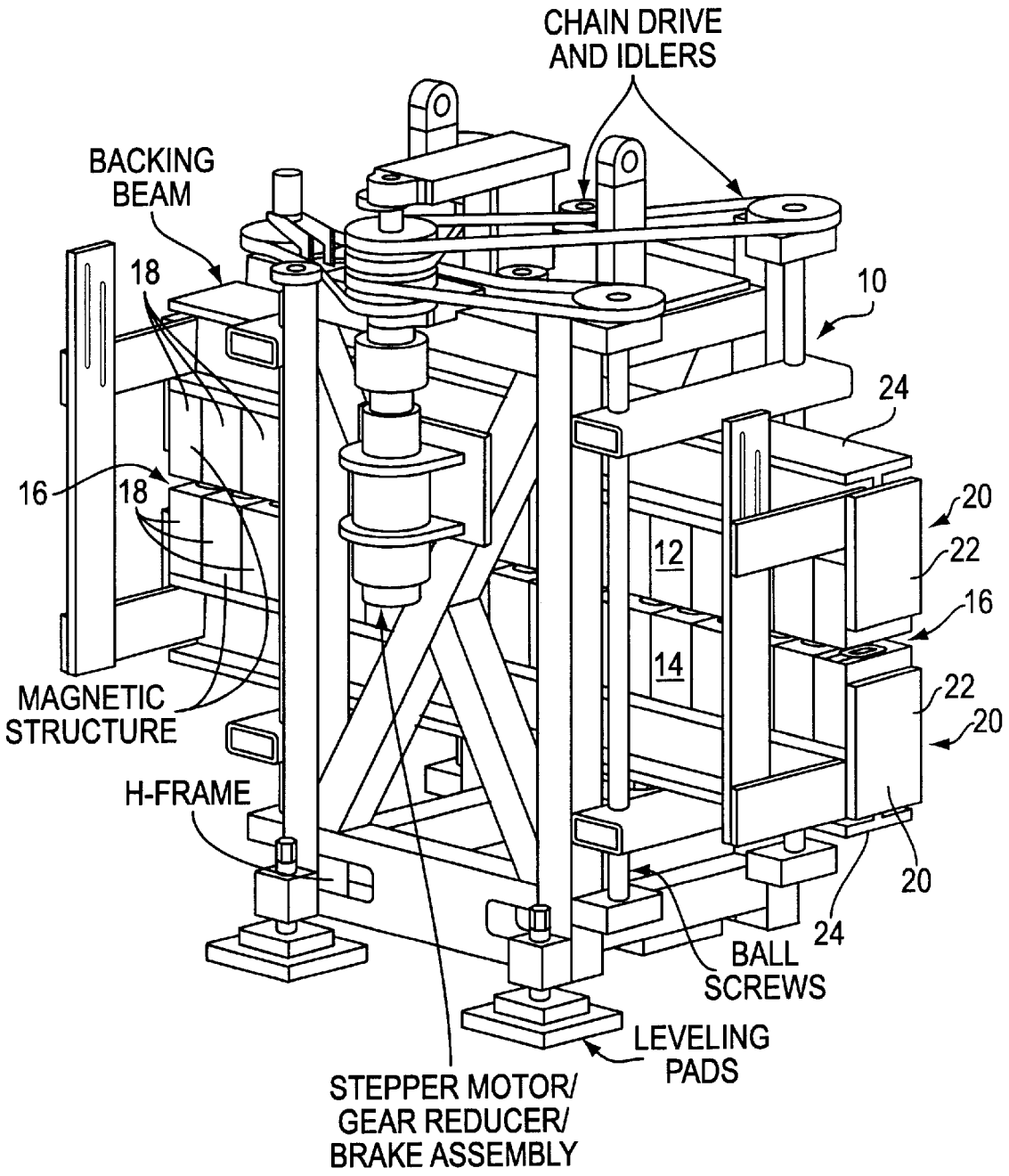
FIG. 1 is a schematic perspective view of a wiggler magnet and pole assembly constructed in accordance with the present invention and adapted for use in a synchrotron.

The invention will now be described in conjunction with the drawings, beginning with FIG. 1 which shows a wiggler magnet assembly 10 adapted for use with a synchrotron. The wiggler magnet assembly 10 includes an upper magnet array 12 and a lower magnet array 14. The magnet arrays 12 and 14 are spaced apart so as to define a longitudinal gap 16 therebetween through which an electron beam may pass.

Figure 2:
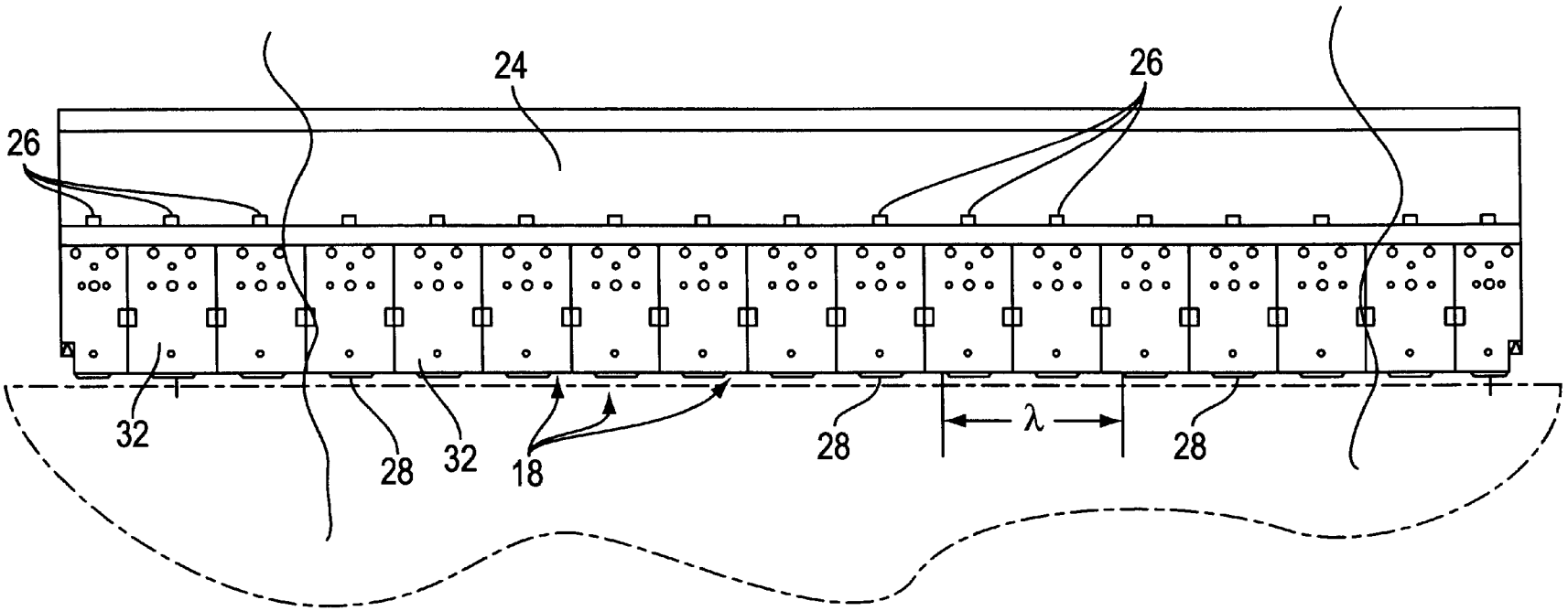
FIG. 2 is a front elevation view of the upper magnet and pole array of FIG. 1.

The magnet arrays 12 and 14 are arranged symmetrically with respect to each other and to the gap 16 in a generally conventional orientation so as to magnetically force a stream of electrons into a generally sinusoidal path as they pass through the gap 16. Each magnet array 12, 14 is constructed from a plurality of pole modules 18. As seen in FIG. 2, the period lambda ( ) of the electron beam's sinusoidal path passing through gap 16 is determined by the longitudinal spacing of the pole modules 18.

Each pole module 18 in each magnet array 12, 14 may be rigidly clamped together by an external mechanical clamping frame which may include end clamps and a backing beam 24. Additional support may be provided by securing each pole module 18 to the backing beam 24 with threaded fasteners 26 as shown in FIG. 2.

Figure 4:
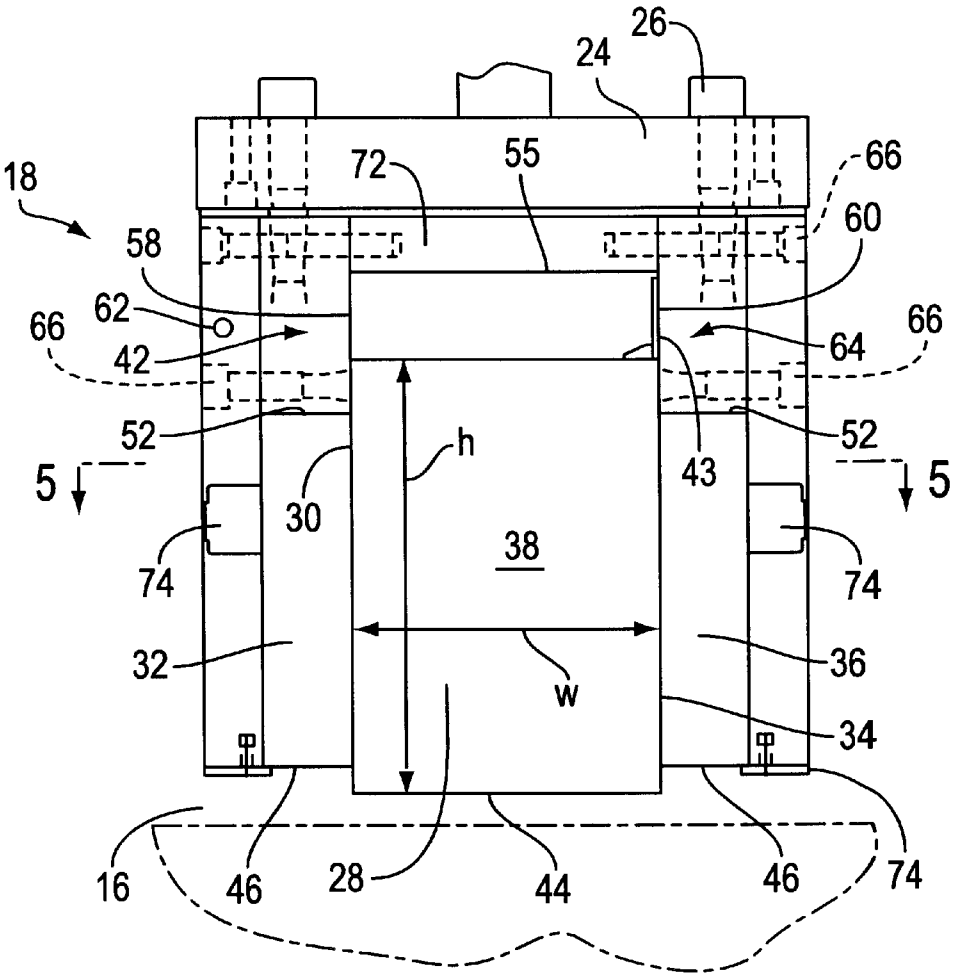
FIG. 4 is a front sectional elevation view of the module of FIG. 3 as taken along section line 4—4 of FIG. 5.
Figure 3:
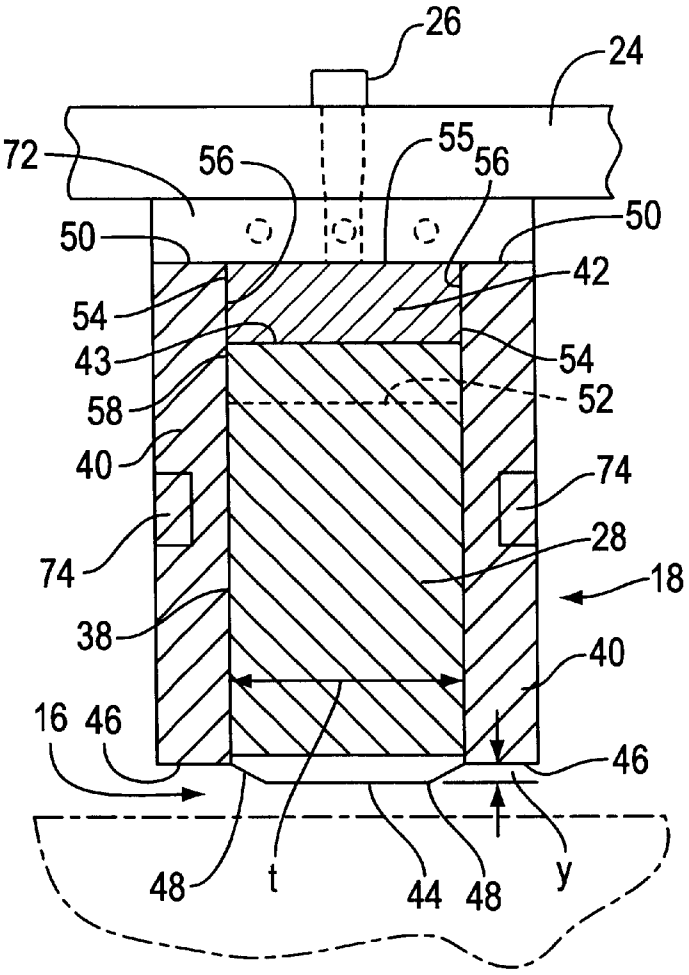
FIG. 3 is an enlarged sectional side elevation view of a single pole module of FIG. 2, as taken along section line 3—3 of FIG. 5.
Figure 5:
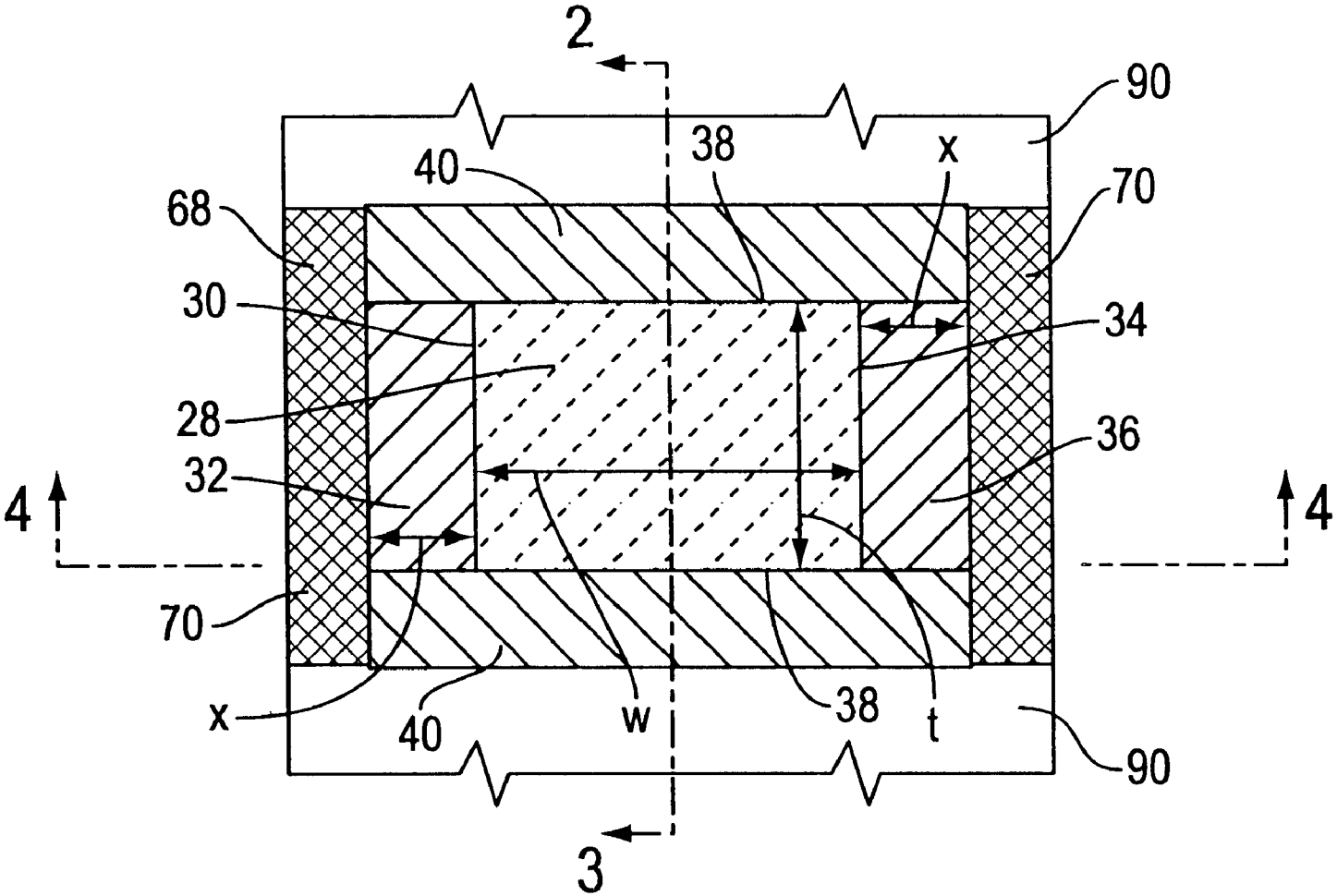
FIG. 5 is a top sectional view as taken along line 5—5 of FIG. 4.

Details of an individual pole module 18 are provided in FIGS. 3, 4 and 5. Each pole module 18 includes a central pole 28 which is surrounded on each of its four sides by a respective block of magnet material. The front face 30 of pole 28 and the rear face 34 of pole 28 are clamped between a front magnet 32 and a rear magnet 36. The side faces 38 of pole 28 are similarly clamped between side magnets 40. An outer end magnet 42 is clamped against the outer rectangular end face 43 of pole 28 which faces away from gap 16. The rectangular face of the outer end magnet 42 which abuts end face 43 is dimensioned the same as end face 43.

Each of the magnets 32, 36, 40, and 42, as well as the pole 28 is shaped as a substantially rectangular parallel-piped block. This facilitates their construction and assembly and minimizes material scrap. The pole pieces are advantageously formed of steel alloy, preferably vanadium permendur, while the magnet blocks are advantageously formed of rare earth materials, preferably neodymium-boron-iron. Certain portions of the poles and magnets may be modified slightly in shape such as by being chamfered, rounded or bored without departing from the scope of the invention.

As seen in FIG. 3, the pole 28 includes a free end portion 44 which projects past the inner ends 46 of magnets 32, 36 and 40 and extends slightly to define the gap 16. Chamfers 48 may be formed along the edges and corners of free end portion 44. The inner ends 46 of magnets 32, 36 and 40 which face the gap 16 are aligned in a first common plane parallel to the gap 16, which is defined by the pole end surface 44. The outer ends 50 of side magnets 40 are aligned in a second common plane parallel to the first plane. The outer ends 52 of the front and rear magnets 32, 36 are further aligned in a third common plane located between and parallel to the first and second planes.

The spaces above the surfaces 52 of the magnets 32, 36 provide space for mechanical retention means necessary for providing good alignment of the magntic modules, in particular the pole piece 28 in an array. By connecting to the rigid backing beam 24, accurate positioning of the pole end 44 is effected relative to the remainder of the structure and modules to form a suitably precise gap 16.

The outer ends 50 of side magnets 40 extend beyond the outer ends 52 of the front and rear magnets 32,36 so as to define a rectangular channel within which outer end magnet 42 is located, as well as the outer end of pole 28. Outer end magnet 42 is dimensioned so that its side faces 54 abut in planar contact against the side surfaces 56 of the side magnets 40. The planar outer surface 55 of outer end magnet 42 is located in the second common plane with the outer ends 50 of the side magnets 40.

As best seen in FIGS. 3 and 4, the outer end face 43 of the pole 28 extends outwardly beyond the outer ends 52 of the front and rear magnets 32, 36. As further seen in FIG. 4, the front and rear faces 58, 60 of the outer end magnet 42 are respectively aligned with and coplanar with the front and rear faces 30, 34 of pole 28. This particular sizing of the pole 28 and outer end magnet 42 results in the formation of a pair of rectangular spaces or gaps 62, 64 located above the outer ends 52 of the front and rear magnets 32, 36 and between the side surfaces 56 of the side magnets 40.

Conventional clamping techniques may be used to tightly secure the pole module components in place without the need for adhesives. For example, various threaded fasteners 66 may secure front and rear aluminum clamping plates 68, 70 directly to the front and rear magnets 32, 36, as well as to an aluminum outer end mounting plate 72. Clips 74 may also be employed to enhance rigidity of the module assembly.

It can now be appreciated that a plurality of individual pole modules 18 may be arranged side by side in a series, as shown in FIG. 2, so as to form a wiggler or undulator device for use in a synchrotron or other charged particle device. The use of rectangular magnet blocks and poles not only facilitates assembly of these modules but also reduces the necessity for large scale material removal. Since the shape and size of side magnets 40 are identical, as are the shape and size of the front and rear magnets 32, 36 fabrication of the individual magnet blocks is facilitated due to their interchangeability.

The dimensions of one preferred optimized embodiment according to the invention are given in FIGS. 3, 4 and 5. The pole height (h) is set at 15.6 cm and the pole width (w) is set at 10.5 cm. The pole thickness (t) is set at 7.5 cm. The width is in a range of 1.1 to 1.7 times larger than the thickness.

The amount of side magnet overhang (x) both above and in front and back of the pole 28 is set at 3.0 cm. The thickness of the side magnets 40 and the thickness of the outer end magnet 42 is set equal to the overhang (x) at 3.0 cm. Finally, the projection of the free end portion 44 of pole 28 past the inner ends 46 of magnets 32, 36 and 40 to define the gap 16 is set at 0.6 cm. With these dimensions, an optimally designed pole is achieved using a minimum of magnet material for achieving a field strength of 2.0 T.

Although the figures and their description above are specific to a rectangular pole piece with rectangular permanent magnets connected to the sides and top of the pole piece, it should be understood that the invention is not so limited. The permanent magnets, in differing shapes and contours, can be used with other pole pieces having different cross sections and contours. For example, the cross section may be round, oval, hexagonal, octagonal, etc., as might be viewed in the direction of FIG. 5. The permanent magnets would be shaped to provide a cladding for the pole piece regardless of the pole shape. Additionally, it is not necessary that all of the lateral surfaces and the top surface be clad with a permanent magnet. Any permanent magnet, even one, attached to any external surface of the pole piece enhances the magnetic flux. Optimal results from cladding a rectangular magnetic assembly were achieved when five pole surfaces were clad with permanent magnets.

Additionally, the field strength of the magnetic module is further improved when the entire module assembly with its pole and permanent magnets is surrounded by high permeability material, that is, exclusive of the face that defines the gap wherethrough the beam of particles flows. Thus, elements 70, 72 (FIGS. 3, 5) can be made of a highly permeable material and additional permeable elements 90 connected to the elements 72, 74 can enclose the module by being applied on the outside of the permanent magnets 40, away from the pole 38 as indicated in FIG. 5.

Obviously, numerous modifications and variations of the present invention are possible in the light of the above teachings. It is therefore to be understood that within the scope of the appended claims, the invention may be practiced otherwise than as specifically described herein.

What is claimed is:

1. A magnetic module for use in periodic magnetic devices, for example, wigglers, undulators, synchrotrons, magnetic separators, free electron lasers, said magnetic module comprising:

a central pole of a high magnetic permeability material formed with an inner end portion, an outer end portion and side portions located between said inner end portion and said outer end portion;

first permanent magnet means surrounding said central pole around at least a portion of said side portions, said first permanent magnet means having first opposed side portions and second opposed side portions, said outer end portion of said pole extending outwardly past said first opposed side portions of said first permanent magnet means, and said second opposed side portions of said first permanent magnet means extending outwardly past said outer end portion of said pole; and second permanent magnet means disposed on said outer end portion of said pole.

2. The module of claim 1, wherein said inner end portion of said pole comprises a free end portion extending inwardly past said first permanent magnet means.

3. The module of claim 1, further comprising a jacket of high permeability material enclosing at least a portion of said assembled module, exclusive of said inner end portion.

4. The module of claim 3, wherein said high permeability material encloses substantially the entire module, exclusive of said inner end portion.

5. The module of claim 1, wherein said pole is a rectangular block.

6. The module of claim 5, wherein said central pole comprises a predetermined width and a predetermined thickness, and wherein said width is in a range of 1.1 to 1.7 times larger than said thickness.

7. The module of claim 6, wherein said width is approximately 1.4 times larger than said thickness.

8. A magnetic module for use in periodic magnetic devices, for example, wigglers, undulators, synchrotrons, magnetic separators, free electron lasers, said magnetic module comprising:

a central pole of a high magnetic permeability material formed with an inner end portion, an outer end portion and side portions located between said inner end portion and said outer end portion;

first permanent magnet means surrounding said central pole around and directly contacting each of said side portions; and second permanent magnet means disposed on said outer end portion of said pole, wherein said side portions of said pole have a plurality of planar side surfaces and said first permanent magnet means includes a plurality of magnets respectively disposed on each of said plurality of planar side surfaces, said inner end portion being entirely unobstructed by permanent magnet means.

9. The module of claim 8, wherein said pole comprises a rectangular block and wherein said first permanent magnet means comprises four rectangular blocks.

10. The module of claim 9, wherein said second permanent magnet means comprises a rectangular block.

11. The module of claim 10, wherein said second permanent magnet means engages a portion of said first permanent magnet means.

12. A magnetic apparatus for use in periodic magnetic devices, for example, wigglers, undulators, synchrotrons, magnetic separators, free electron lasers, said apparatus comprising:

a first magnetic array comprising a plurality of first magnetic modules aligned in a first series;

a second magnetic array aligned with said first magnetic array and comprising a plurality of second magnetic modules aligned in a second series;

said first and second magnetic arrays defining a gap therebetween for the passage of charged particles therethrough;

said first and second magnetic modules each comprising a central pole of a high magnetic permeability material having an inner end portion defining said gap, an outer end portion extending away from said gap, and side portions located between said inner and outer end portions; and permanent magnet means disposed on at least some of said side portions and on said outer end portion of said central pole, said central pole including a first rectangular block and said permanent magnet means including five rectangular blocks.

13. The apparatus of claim 12, wherein said side portions of said central pole comprise four sides of said first rectangular block and said outer end portion of said central pole comprises a fifth side of said first rectangular block and said five rectangular blocks of said permanent magnet means are respectively disposed on said four sides and said fifth side of said central pole.

14. The apparatus of claim 13, wherein said inner end portion of said central pole comprises a sixth side of said rectangular block.

15. The apparatus of claim 14, wherein said central pole comprises steel and wherein said permanent magnet means comprises rare earth permanent magnets.

16. The apparatus of claim 15, wherein four of said five rectangular blocks form two pairs of rectangular blocks located on opposing sides of said central pole and wherein each pair of rectangular blocks comprises two blocks having substantially equal shapes.

17. The apparatus of claim 16, wherein the shape of said two blocks in said first pair of blocks is different from the shape of said two blocks in said second pair of blocks.

18. A magnetic apparatus for use in periodic magnetic devices, for example, wigglers, undulators, synchrotrons, magnetic separators, free electron lasers, said module comprising:

a first magnetic array comprising a plurality of first magnetic modules aligned in a first series;

a second magnetic array aligned with said first magnetic array and comprising a plurality of second magnetic modules aligned in a second series;

said first and second magnetic arrays defining a gap there-between for the passage of charged particles there through;

said first and second magnetic modules each comprising a central pole of a high magnetic permeability material having an inner end portion defining said gap, an outer end portion extending away from said gap, and side portions located between said inner and outer end portions; and permanent magnet means disposed on at least some of said side portions and on said outer end portion of said central pole.

wherein pole width is approximately 1.4 times larger than pole thickness.

* * * * *